US005496167A

United States Patent [19]

Diaz

[11] Patent Number: 5,496,167

[45] Date of Patent: Mar. 5, 1996

[54] VIBRATING ARRANGEMENT

[76] Inventor: Antonio P. Diaz, Poligono Industrial Juncarril, Parcela 240, 18220 Albolote (Granada), Spain

[21] Appl. No.: 161,321

[22] Filed: Dec. 2, 1993

[30] Foreign Application Priority Data

Dec. 3, 1992 [EP] European Pat. Off. ..... 9203576

[51] Int. Cl.[6] ..... B28B 1/08; B06B 1/16

[52] U.S. Cl. ..... 425/456; 74/61; 425/432

[58] Field of Search ..... 74/61; 425/432, 425/424, 456

[56] References Cited

U.S. PATENT DOCUMENTS

| | | | |
|---|---|---|---|
| 3,332,293 | 7/1967 | Austin et al. . | |
| 4,481,835 | 11/1984 | Storm | 74/61 |
| 4,483,621 | 11/1984 | Kreiskorte | 425/456 |
| 5,067,358 | 11/1991 | Ancrenaz | 74/61 |

FOREIGN PATENT DOCUMENTS

| | | |
|---|---|---|
| 0515305 | 11/1992 | European Pat. Off. . |
| 0400510 | 12/1990 | France . |
| 2659574 | 9/1991 | France . |

*Primary Examiner*—James P. Mackey
*Attorney, Agent, or Firm*—Flynn, Thiel, Boutell & Tanis

[57] ABSTRACT

A vibrating unit having a table driven by two oppositely-rotating vibration generators arranged in parallel. Each vibration generator has coaxial first and second eccentric mass shafts which are relatively rotatable between a first position producing no vibration and a second position where vibration is produced. First and second driving systems respectively include a first double-toothed drive belt drivingly engaged with each of the first shafts to effect counterrotation thereof, and a second double-toothed belt drivingly engaged with each of the second shafts to effect counterrotation thereof. A position adjusting assembly is associated with one of the driving system for permitting the eccentric mass shafts associated therewith to be angularly adjusted relative to the eccentric mass shafts of the other driving system during rotational driving of the vibration generators to permit the vibration generators to be adjusted between a vibration-producing position and a nonvibrating position.

5 Claims, 4 Drawing Sheets

VIBRATING ARRANGEMENT

FIELD OF THE INVENTION

The present application relates to a vibrating arrangement for machinery which exhibits remarkable advantages and innovations relative to known arrangements which are used for the same or similar purpose.

BACKGROUND OF THE INVENTION

Several arrangements are presently known in the industry to produce vibrations. These arrangements undergo repetitive starting and stopping to select between vibration and nonvibration modes. The numerous startings and stoppings unavoidably speeds up mechanical wear and remarkably increases energy consumption and expense.

To avoid these drawbacks, the vibrating arrangement or unit of the present invention has been devised, and is particularly designed to be used in vibrocompressing machines in the manufacture of concrete molded components.

The vibrating arrangement of this invention comprises a vibrating table driven by two vibration generators each made up by two coaxial rotating shafts with eccentric masses. The two vibration generators are arranged in parallel and are driven in opposite directions by a drive chain engagement. This drive chain arrangement can be adjusted, while effecting rotation of the vibration generators, to relatively adjust the vibration generators from a vibration generating position to a nonvibration position without stopping the rotation of the overall arrangement.

To provide for a more detailed description of the present invention, the annexed figures illustrate, by way of example, a preferred embodiment.

DETAILED DESCRIPTION

Figures 1, 1A, 1B:
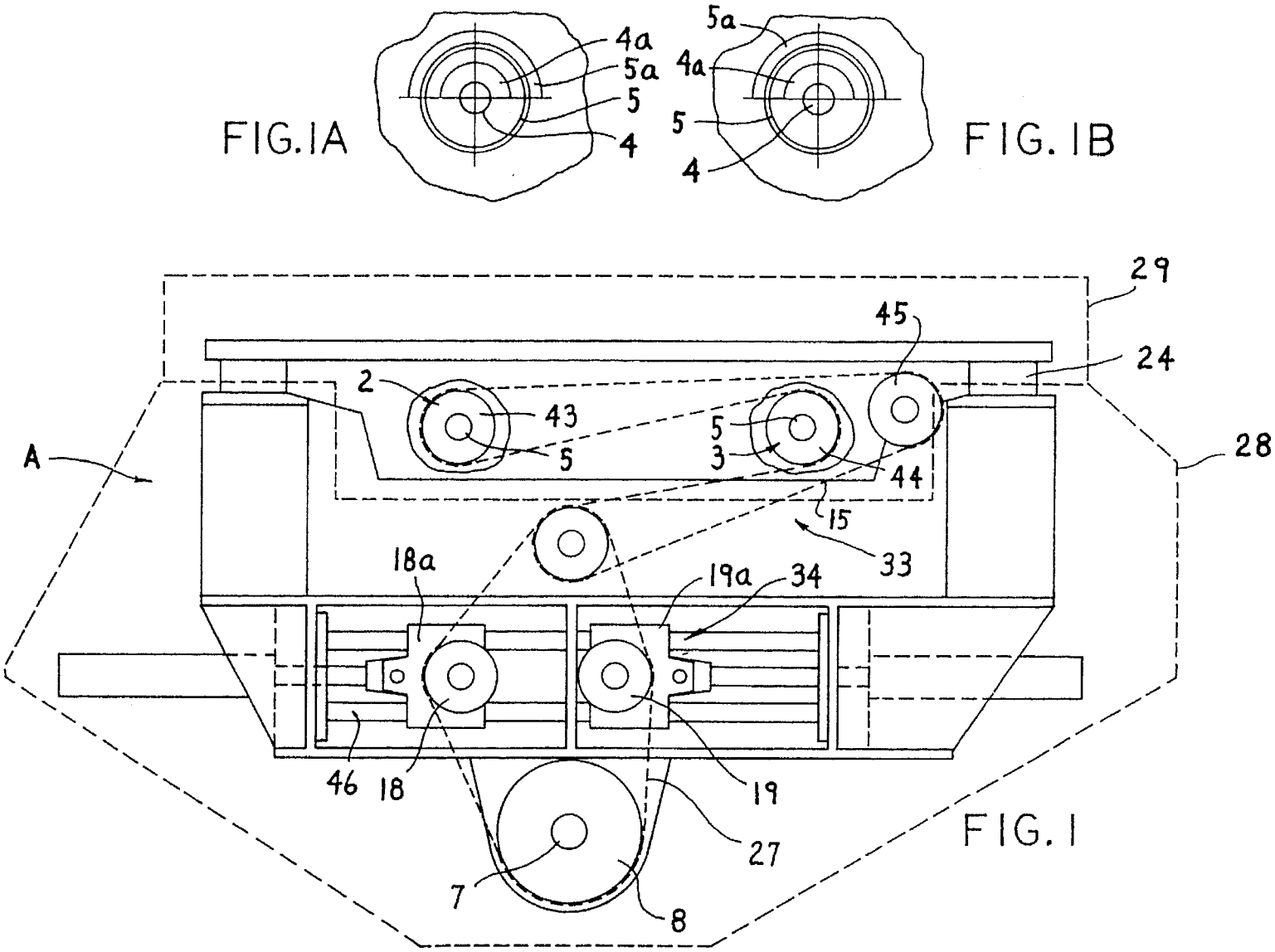
FIG. 1 is a front view of the vibrating unit.
FIGS. 1A and 1B are enlarged detail views of the vibration generators shown in the position where vibration is caused.
Figure 2B:
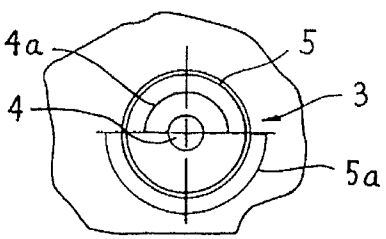
FIGS. 2, 2A and 2B are views similar to FIGS. 1, 1A and 1B except the vibration generators are shown in a position where no vibration is produced.
Figure 2A:
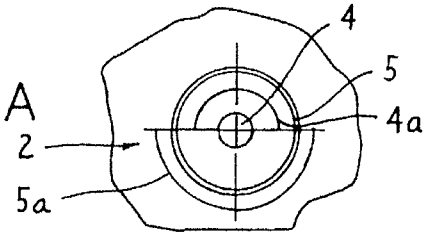
Figure 2:
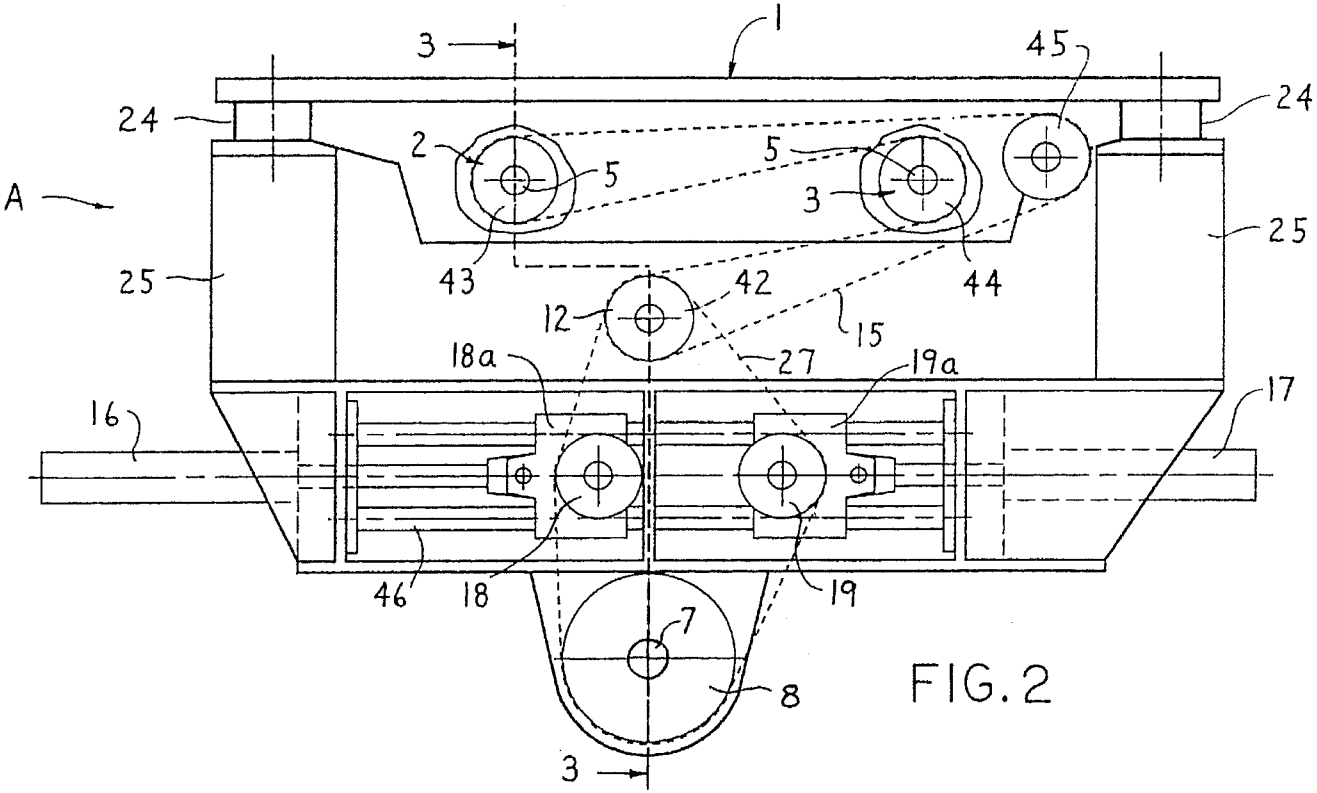
Figure 3:
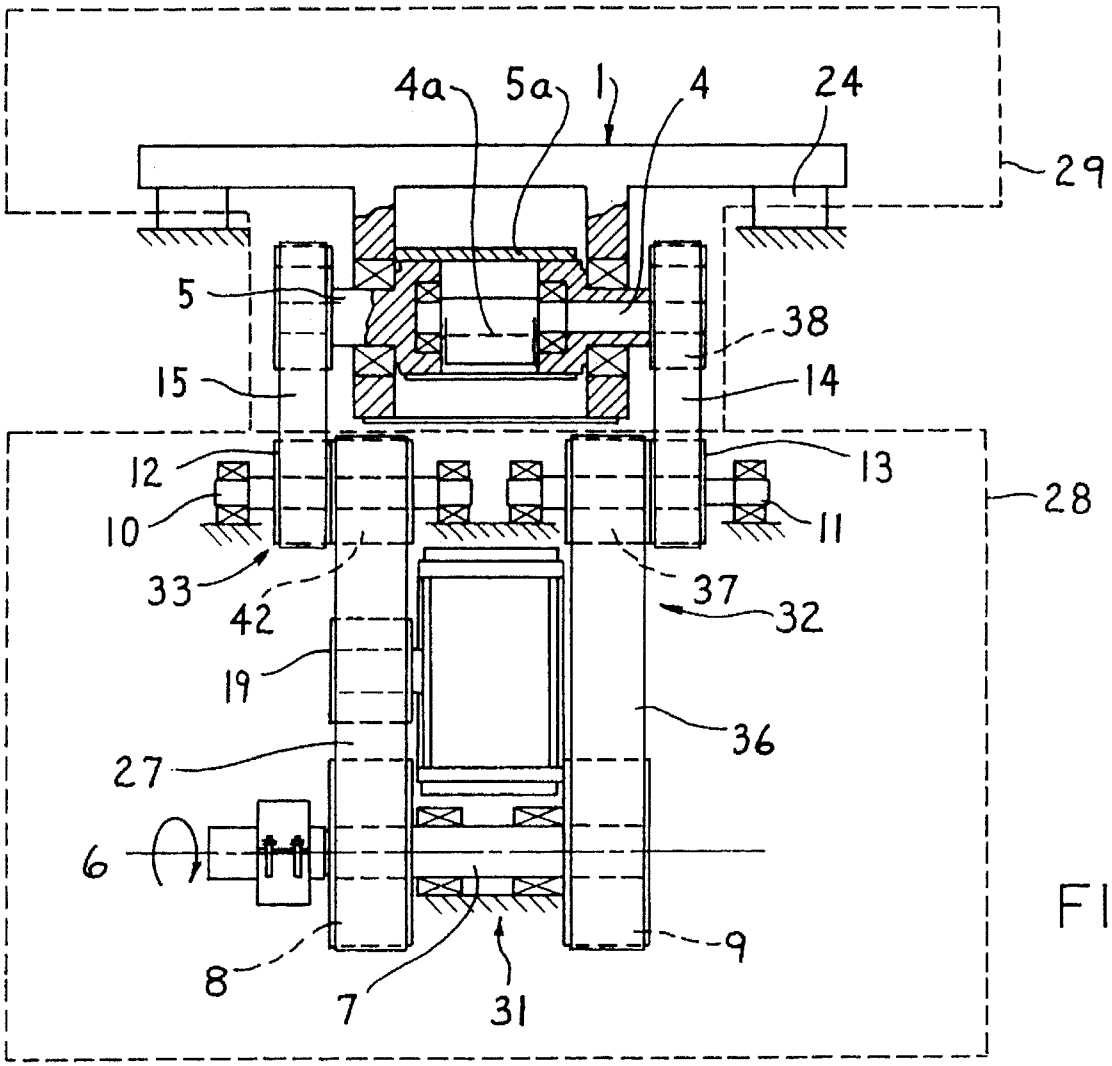
FIG. 3 is a cross-section view taken along line 3—3 in FIG. 2.
Figure 4A:
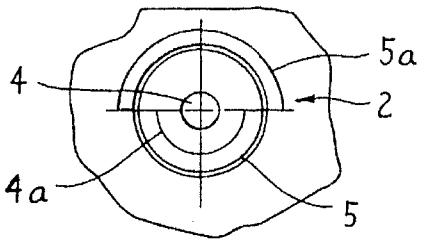
FIG. 4 is a rear view of the vibrating unit as illustrated in FIG. 2, and FIGS. 4A and 4B show the position of the vibration generators.
Figure 4B:
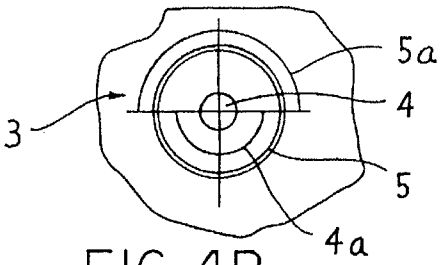
Figure 4:
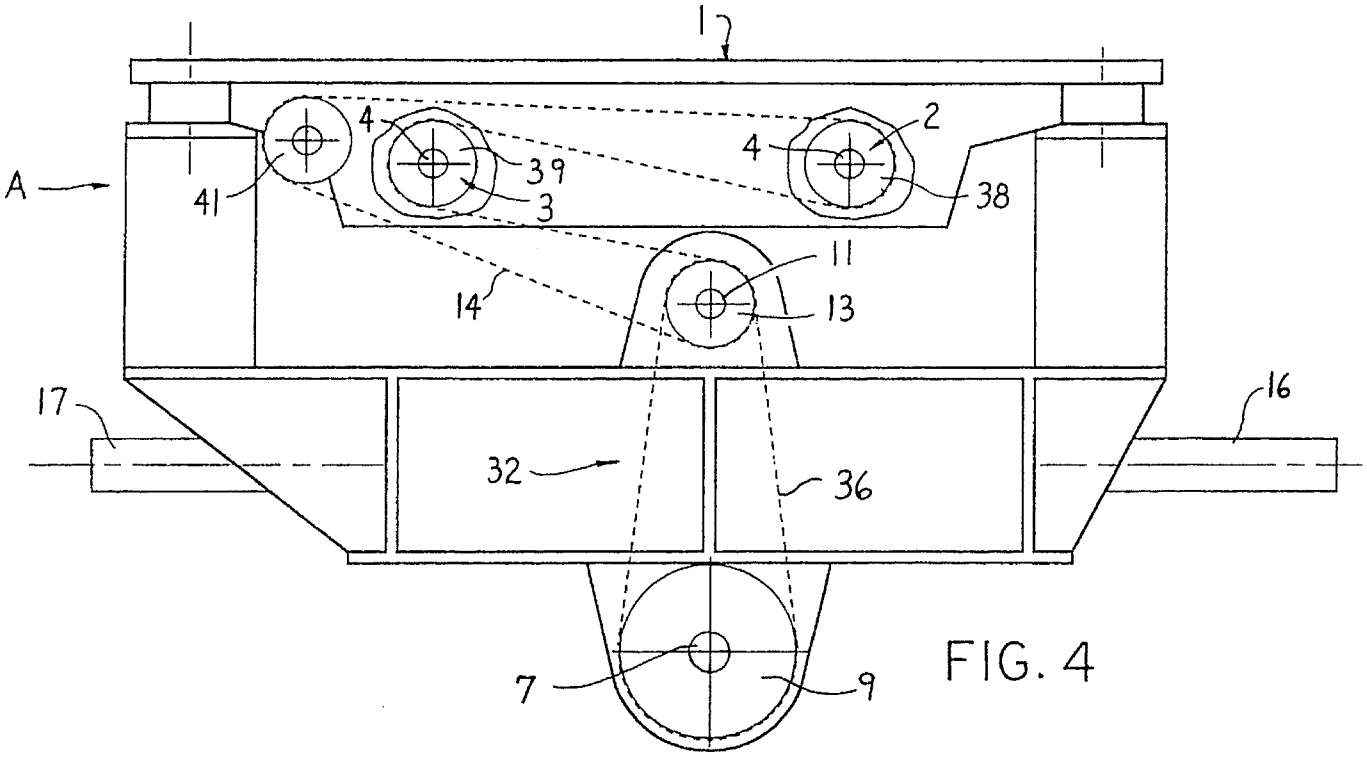

Referring to the drawings, there is illustrated an embodiment of a vibrating unit or arrangement A for machinery, comprising a table 1 driven (i.e. vibrated) by two vibration generators 2 and 3 which are arranged in parallel and are oppositely rotated. Each vibration generator 2 and 3 is, as shown in FIG. 3, defined by two rotatable shafts 4 and 5 which are coaxially aligned and rotatably supported on the underside of the table 1. These shafts 4 and 5 respectively mount thereon eccentric weights or masses 4*a* and 5*a*. In the illustrated embodiment, the shaft 5 is rotatably supported by suitable bearings on the underside of the table 1, and the other shaft 4 is rotatably supported by suitable bearings coaxially inside of the shaft 5. The shafts 4 and 5 of each vibration generator can be relatively rotated with respect to one another between a first operating mode position wherein the weights 4*a* and 5*a* are positioned generally on the same side of the rotational axis as illustrated by FIG. 1, this being a vibration generating mode, and a second operating mode position wherein the weights 4*a* and 5*a* are disposed generally radially on opposite sides of the rotational axis as illustrated by FIG. 2 so as to effectively balance one another to prevent generation of vibration when the shafts 4 and 5 are simultaneously rotated.

The two vibration generators 2 and 3 are appropriately rotatably driven by a drive unit 31 which, in the illustrated embodiment includes a plurality of flexible endless drive elements, preferably toothed belts. This drive unit 31 effects counterrotation of the vibration generators 2 and 3 when in the vibration mode of FIG. 1 so as to impose vertical vibration (alternative upwardly and downwardly directed vibration impulses) onto the table 1. Similarly, the rotation of the vibration generators 2 and 3 when disposed in the nonvibration generating mode of FIG. 2 results in imposition of no vibration on the table 1. This drive unit 31, however, also includes means for adjusting the relative position between the eccentric weights 4*a* and 5*a* of each vibration generator during rotation thereof so as to permit adjustment between the vibration and nonvibration modes.

The drive unit 31 includes a first drive train 32 for effecting counterrotation of the two shafts 4 associated with the vibration generators 2 and 3, and a second drive train 33 which is generally parallel with the drive train 32 and effects counterrotation of the two shafts 5 associated with the generators 2 and 3. This latter drive train 33 also has a position adjusting device 34 associated therewith for permitting selection between the vibration and nonvibration modes, as described hereinafter.

More specifically, the drive unit 31 includes a suitable drive motor 6 which drives a main drive shaft 7 which in turn mounts thereon two drive pulleys 8 and 9, the latter being respectively associated with the drive trains 32 and 33.

As to the drive train 32, the drive pulley 9 drives an endless drive belt 36 which in turn drives a pulley 37 secured to an intermediate rotatable shaft 11. This latter shaft 11 in turn mounts thereon a further pulley 13 which is engaged with and drives a further endless drive belt 14. This belt 14 in turn is drivingly engaged with the pulleys 38 and 39 which are nonrotatably secured to the shafts 4 associated with the vibration generators 2 and 3 respectively. This drive belt 14 also passes over an intermediate tensioning pulley 41 so that the belt 14 engages the pulleys 38 and 39 reversely to cause the pulleys 38 and 39, and consequently the shafts 4 of the vibration generators 2 and 3, to rotate in opposite rotational directions.

In similar fashion, the other drive train 33 includes an endless drive belt 27 which is engaged with the drive pulley 8 for effecting driving of a further pulley 42 which is nonrotatably secured to a further intermediate rotatable shaft 10, the latter being generally coaxially aligned with the shaft 11. This shaft 10 in turn has a further pulley 12 secured thereto, which in turn is engaged with a further drive belt 15, the latter being generally identical to the belt 14 in that this belt 15 is drivingly engaged with a pair of spaced pulleys 43 and 44. These pulleys 43 and 44 are nonrotatably secured to the shafts 5 associated with the vibration generators 2 and 3 respectively. The drive belt 15 also is engaged with an intermediate tensioning pulley 45 which is coaxially aligned with the pulley 41, and the pulley 45 in turn causes the belt 15 to reversely engage the pulleys 43 and 44 so that the latter effect rotation of the shafts 5 of the respective vibration generators 2 and 3 in opposite rotational directions. However, it should be noted that the shafts 4 and 5 of the vibration generator 2 both rotate in the same direction, and the shafts 4 and 5 of the vibration generator 3 also both rotate in the same direction, but the shafts of generator 3 rotate in the opposite direction relative to the shafts of generator 2.

The drive train 33 also has the position adjusting device 34 associated therewith, the latter permitting the rotational position of the shafts 5 to be relatively angularly adjusted relative to the position of the respective shafts 4 to enable the eccentric masses or weights 5*a* to be adjusted between the vibration mode of FIG. 1 and the nonvibration mode of FIG. 2.

To permit this adjustment, the position or mode adjusting device 34 includes a pair of intermediate position adjusting pulleys 18 and 19 which are respectively rotatably supported on slide blocks 18*a* and 19*a*. The pulleys 18 and 19 respectively engage the opposed belt reaches of the belt 27 as these reaches extend between the pulleys 8 and 42. The slide blocks 18*a* and 19*a* in turn are slidably supported on elongate guide rods 46 so that the slide blocks 18*a* and 19*a*, and the pulleys 18 and 19 respectively mounted thereon, can be adjustably moved in a direction which extends transverse to the belt reaches, and more specifically perpendicularly to the plane which contains the axes of the shafts 7 and 10. Thus, this enables the pulleys 18 and 19 to move generally transversely relative to the respective belt reach with which the pulleys are engaged, to thus alter or change the length of the belt reaches and thus alter the configuration of the belt 27.

In the illustrated embodiment, the slide block 18*a* is connected to a driving device 16, such as a fluid pressure cylinder. Similarly, slide block 19*a* is secured to another drive device 17, such as a fluid pressure cylinder. These cylinders are normally air cylinders, but can obviously be operated by any desired fluid.

When the adjusting device 34 is in the position illustrated by FIG. 1, in which position the intermediate pulley 18 effects a significant outward deflection and hence lengthening of the leftward belt reach of the drive belt 27, this results in the shafts 5 and associated eccentric weights 5*a* being generally radially aligned with the weights 4*a* substantially as illustrated in FIGS. 1A and 1B so as to cause the device to be in a vibration-producing or generating position. Conversely, when cylinders 16 and 17 are energized to shift the pulleys 18 and 19 rightwardly in FIG. 1 so that the opposite belt reach is then deflected rightwardly a substantial distance by the pulley 19, such as illustrated by FIG. 2, this movement from the FIG. 1 position to the FIG. 2 position causes a lengthening of the opposite belt reach so that the shafts 5 are rotated 180° relative to the respective shafts 4, whereby the weights 4*a* and 5*a* of each vibration generator are now disposed in generally radially opposed positions to create a rotatably balanced condition associated with each vibration generator, as shown in FIGS. 2A and 2B, whereby no vibration is produced when the shafts 4 and 5 are simultaneously rotated.

With this arrangement, the driving power from the motor is shared equally by the four rotating eccentric weight shafts 4 and 5 due to the manner in which the shafts and driving trains are positioned and proportioned.

Further, all of the pulleys and belts are preferably toothed to provide for positive driving, with the belts 14 and 15 being preferably double-toothed belts, i.e., belts provided with teeth on both sides thereof inasmuch as the reverse wrap around of these belts on the respective drive pulleys requires that they have teeth on both sides thereof.

With the drive unit 31 and specifically the drive trains 32 and 33 cooperating as described above, and when the motor is rotatably driving the shaft 7, then the belt 14 causes the two shafts 4 to rotate at the same speed but in opposite rotational directions, and at the same time the belt 15 also causes the two shafts 5 to also rotate at the same speed but in opposite rotational directions, whereby each cooperating pair of shafts 4 and 5 simultaneously rotate in the same direction, with the two separate pairs of cooperating shafts 4 and 5 rotating in opposite directions. However, while the rotational driving of the shafts 4 and 5 occurs, the pulleys 18 and 19 can be suitably shifted from the vibration mode position of FIG. 1 to the nonvibration mode position of FIG. 2 by suitable energization of the cylinders 16 and 17. This causes a shifting in the position of the drive belt 27 which is transmitted through the belt 15 to cause the shafts 5 to be angularly adjusted through an angle of 180° relative to the respective shafts 4. This adjustment occurs while all of the shafts 4 and 5 continue to rotate, so that no starting or stopping of the overall vibrating unit is required.

Thus, this vibrating arrangement A using the drive device 31 detailed above provides either vibration or no vibration according to the mode positions of FIG. 1 or FIG. 2, respectively, and is capable of doing so without stopping the rotation.

The shifting stroke of cylinders 16 and 17 can also be varied so that the positions of the eccentric masses 4 and 5 can also be made variable, so that a stronger or weaker vibrating power can thereby be achieved.

Also, the position adjusting device 34 can be provided with a single pressure cylinder or any other type of mechanical pusher to effect simultaneous shifting of pulleys 18 and 19, or their shifting motions may be obtained using springs, or gravity-urged counterweights.

The reference numerals 24 designate antivibrating supports (i.e. cushions) for supporting the vibrating table 1 on columns or frame bases 25 to isolate the vibrations therefrom.

Finally, as illustrated in FIGS. 1 and 3, to indicate that the overall device comprises two basic units, the dotted region 28 represents the base or frame structure which is isolated from the vibration, and the dotted region 29 represented the structure 29 which is subject to the vibration. These regions 28 and 29 are separated by the antivibrating supports 24 and the particular arrangement of belts 14 and 15.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A vibrating unit for machinery, comprising:

a frame;

a table supported on the frame through vibration-isolating cushions to permit vertical vibration of the table relative to the frame while substantially isolating the frame from the vibrations;

first and second vibration generators rotatably mounted on said table in generally parallel but sidewardly spaced relationship for permitting imposition of a vertically oriented up-and-down vibration on the table;

each said vibration generator including first and second coaxially aligned and rotatable shafts which respectively mount thereon first and second radially eccentric weights, the first and second radially eccentric weights of each said vibration generator being sized and positioned so as to be effectively balanced and induce no rotational vibration when the weights are disposed in a first position wherein they are substantially radially opposed, said weights when relatively moved into a second position wherein they are both disposed in the same radial direction being such as to create an unbalanced vertical vibratory force when the respective vibration generator is rotated;

first and second drive trains connected between said table and said frame for rotatably driving both of said first and second vibration generators at the same rotational speeds but in opposite rotational directions;

said first drive train including first flexible drive belt means drivingly connected to and driven from a first driving pulley which is rotatably supported on said frame, said first drive belt means being drivingly engaged with the first shaft of each of said first and second vibration generators for effecting simultaneous and synchronous rotation of each of said first shafts in an opposite rotational direction relative to the other of said first shafts;

said second drive train including second flexible drive belt means drivingly engaged with and driven from a second driving pulley which is rotatably supported on said frame, said second drive belt means being drivingly engaged with each of the second shafts of said first and second vibration generators for causing simultaneous and synchronous rotation of each of said second shafts in an opposite direction relative to the other of said second shafts; and position adjusting means cooperating with said second drive belt means for adjusting the position of said second drive belt means relative to said first drive belt means during the simultaneous rotations thereof to cause a corresponding angular adjustment in the positions of said second shafts relative to said first shafts to enable the eccentric weights on said second shafts to be angularly adjusted relative to said first shafts;

said position adjusting means comprising at least one elongate guide member mounted to said frame and extending transverse to first and second intermediate belt reaches of said second drive belt means, first and second intermediate position-adjusting pulleys engaged with said first and second intermediate belt reaches respectively and rotatably mounted on respective first and second slide members which are slidably engaged with said guide member, and driving means for shiftably moving said slide members transversely in the same direction along said guide member to move said intermediate position-adjusting pulleys for changing the lengths of said intermediate belt reaches and angularly adjusting said second shafts relative to said first shafts.

2. A vibrating unit according to claim 1, wherein each of said first and second drive trains includes a toothed driving belt engaged with the respective driving pulley and a toothed driven belt engaged with pulleys associated with the respective shafts, said driving and driven belts being engaged with suitable end pulleys mounted on a rotatable intermediate shaft.

3. A vibrating unit according to claim 2, wherein said end pulleys and said intermediate shaft are rotatably mounted on said frame, and wherein said driven belts extend between the end pulleys on said frame and the shaft pulleys on said table to isolate transmission of vibrations from the table to the frame.

4. A vibrating unit according to claim 1, wherein said first and second shafts coaxially aligned with one another each have distal first ends and mutually adjacent second ends, one of said second ends being hollow and rotatably receiving therein the other of said second ends, said second ends having said eccentric weights mounted thereon which are axially positioned on said mutually adjacent second ends so as to be effectively balanced.

5. A vibrating unit for machinery, comprising:

a frame;

a table supported on the frame through vibration-isolating cushions to permit vertical vibration of the table relative to the frame while substantially isolating the frame from the vibrations;

first and second vibration generators rotatably mounted on said table in generally parallel but sidewardly spaced relationship for permitting imposition of a vertically oriented up-and-down vibration on the table;

each said vibration generator including first and second coaxially aligned and rotatable shafts which each have distal first ends and mutually adjacent second ends, one of said second ends being hollow and rotatably receiving therein the other of said second ends, said first and second shafts each having a shaft pulley mounted on said distal first ends for rotation thereof and respectively mounting on said mutually adjacent second ends first and second radially eccentric weights for causing said vibration, the first and second radially eccentric weights of each said vibration generator being sized and radially and axially positioned on said mutually adjacent second ends so as to be effectively balanced and induce no rotational vibration when the weights are disposed in a first position wherein they are substantially radially opposed, said weights when relatively moved into a second position wherein they are both disposed in the same radial direction being such as to create an unbalanced vertical vibratory force when the respective vibration generator is rotated;

first and second driving pulleys mounted on a main drive shaft rotatably supported on said frame;

means for rotating said main drive shaft;

first and second drive trains connected between said table and said frame for rotatably driving both of said first and second vibration generators at the same rotational speeds but in opposite rotational directions;

said first drive train including first flexible drive belt means drivingly connected to and driven from said first driving pulley, said first drive belt means being drivingly engaged with the shaft pulley of the first shaft of each of said first and second vibration generators for effecting simultaneous and synchronous rotation of each of said first shafts in an opposite rotational direction relative to the other of said first shafts;

said second drive train including second flexible drive belt means drivingly engaged with and driven from said second driving pulley, said second drive belt means being drivingly engaged with the end pulleys of the second shafts of said first and second vibration generators for causing simultaneous and synchronous rotation of each of said second shafts in an opposite rotational direction relative to the other of said second shafts;

each of said first and second drive trains including a toothed driving belt engaged with the respective driving pulley and a toothed driven belt engaged with said shaft pulleys associated with the respective shafts, said driving and driven belts being engaged with end pulleys mounted on a rotatable intermediate shaft mounted on said frame, said driven belts extending between the end pulleys on said frame and the shaft pulleys on said table to isolate transmission of vibrations from the table to the frame; and position adjusting means cooperating with said driven belt of said second drive belt means for adjusting the position of said second drive belt means relative to said first drive belt means during the simultaneous rotations thereof to cause a corresponding angular adjustment in the positions of said second shafts relative to said first shafts to enable the eccentric weights on said second shafts to be angularly adjusted between said first and second positions relative to said first shafts;

said position adjusting means including a first intermediate position-adjusting pulley engaged with a first intermediate belt reach of said driving belt of said second drive belt means, a driving device for shiftably moving said first intermediate position-adjusting pulley transversely relative to said first intermediate belt reach for changing the length of said first intermediate belt reach to change the position of the second drive belt means relative to said first drive belt means, at least one elongate guide member mounted to said frame and extending transverse to said first intermediate belt reach and a second intermediate belt reach of said driving belt of said second drive belt means, a second intermediate position-adjusting pulley engaged with said second intermediate belt reach, and first and second slide members slidingly engaged with said guide member and respectively having said first and second intermediate position-adjusting pulleys rotatably mounted thereon, said driving device operatively engaging said first and second slide members for shiftably moving said slide members transversely in the same direction along said guide member to move said intermediate position-adjusting pulleys for changing the lengths of said intermediate belt reaches and angularly adjusting said second shafts relative to said first shafts.

* * * * *

UNITED STATES PATENT AND TRADEMARK OFFICE

CERTIFICATE OF CORRECTION

PATENT NO. : 5 496 167

DATED : March 5, 1996

INVENTOR(S) : Antonio Poyatos Diaz

It is certified that error appears in the above-indentified patent and that said Letters Patent is hereby corrected as shown below:

On the title page, Section [30], second line;
change "[EP] European Pat. Off." to
---[ES] Spain---.

Signed and Sealed this

Twenty-seventh Day of August, 1996

*Attest:*

Bruce Lehman

BRUCE LEHMAN

*Attesting Officer*

*Commissioner of Patents and Trademarks*